US006598529B2

(12) United States Patent
Müller

(10) Patent No.: US 6,598,529 B2
(45) Date of Patent: Jul. 29, 2003

(54) METHOD AND DEVICE FOR DETECTING FAULTS DURING TRANSPORT OF A WEB

(75) Inventor: Tobias Müller, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 159 days.

(21) Appl. No.: 09/906,474

(22) Filed: Jul. 16, 2001

(65) Prior Publication Data

US 2002/0017212 A1 Feb. 14, 2002

(30) Foreign Application Priority Data

Jul. 14, 2000 (DE) ..... 100 34 388

(51) Int. Cl.[7] ..... B41F 33/00; B65H 16/00

(52) U.S. Cl. ..... 101/484; 226/1; 226/10; 226/45; 226/100; 101/483

(58) Field of Search ..... 101/484, 483; 226/1, 10, 45, 100

(56) References Cited

U.S. PATENT DOCUMENTS

| | | | | |
|---|---|---|---|---|
| 5,779,123 A | | 7/1998 | Richards | |
| 5,810,235 A | | 9/1998 | Hoynant et al. | |
| 6,056,682 A | * | 5/2000 | Belanger et al. | 493/340 |
| 6,138,496 A | * | 10/2000 | Allmann et al. | 73/9 |
| 2002/0017212 A1 | * | 2/2002 | Muller | 101/484 |
| 2002/0074087 A1 | * | 6/2002 | Hashimoto | 156/362 |

FOREIGN PATENT DOCUMENTS

| | | |
|---|---|---|
| DE | 40 29 927 A1 | 5/1991 |
| DE | 40 03 659 A1 | 8/1991 |
| DE | 41 30 679 C2 | 3/1993 |
| DE | 42 21 395 A1 | 1/1994 |
| DE | 44 41 864 A1 | 6/1995 |
| DE | 196 11 878 A1 | 11/1996 |
| DE | 198 22 375 A1 | 11/1999 |
| GB | 2 236 983 A | 4/1991 |
| WO | WO 96/26147 | 8/1996 |

* cited by examiner

*Primary Examiner*—Charles H Nolan, Jr.
(74) *Attorney, Agent, or Firm*—Laurence A. Greenberg; Werner H. Stemer; Gregory L. Mayback

(57) ABSTRACT

A method for detecting faults during transport of a web in a web-fed printing machine, wherein web speed is determined by contact-free measurement, in accordance with the Doppler principle, includes the steps of: by applying microwaves, determining a first local speed of the web at a first measurement position; by applying microwaves, determining at least a second local speed of the web at a second measurement position spaced apart from the first measurement position in a direction of web transport; determining an actual value from the first local speed and at least the second local speed; determining any deviation of the actual value from a predefined desired value; and comparing the deviation of the actual value from the predefined desired value with a predefined threshold; a detecting device for performing the method; and a printing machine including the detecting device.

14 Claims, 4 Drawing Sheets

METHOD AND DEVICE FOR DETECTING FAULTS DURING TRANSPORT OF A WEB

BACKGROUND OF THE INVENTION

Field of the Invention

The invention relates to a method for detecting faults during transport of a web, in particular, for detecting a web break during the transport of a paper web in a web-fed rotary printing machine, wherein the speed of the web is determined by contact-free or contactless measurement, in accordance with the Doppler principle, and is evaluated thereafter.

The invention also relates to a device for detecting a fault during a web transport, in particular, for detecting a web break during the transport of a paper web in a web-fed rotary printing machine, the device including a detector for determining the speed of the web free of any contact, in accordance with the Doppler principle, and supplying the determined speed value to an evaluation unit disposed downline therefrom, as viewed in the transport direction of the web.

The published German Patent Document DE 196 11 878 A1 discloses a method for detecting faults during the transport of a continuous paper web in a printing machine, wherein a determination of the speed of the web is performed in accordance with a classic, contact-free method by an optical route or with the aid of sound, and is then evaluated. The instantaneous speed of the web, determined in this manner, is compared either with a virtual speed of the web determined from the mechanical speed of the printing machine, with the average speed of the web measured during the time before the measurement of the instantaneous speed, or with a speed of the web at a time immediately before measuring the instantaneous speed. The difference between the instantaneous speed and the comparison speed is then compared with a predefined threshold. If the threshold is exceeded, a web-catching device can be triggered and/or the printing machine can be stopped.

A disadvantage of the aforedescribed method wherein changes in the speed of the web, which are not caused by a web break and are brought about, for example, by longitudinal oscillations of the web, trigger a machine stoppage and can activate a Web-catching device. The aforedescribed method, because it determines the speed at only one point on the web, is unable to distinguish such an oscillation of the web from a change in the speed which results from a web break. However, a machine stoppage leads to an enormous time loss for the pressman and to considerable costs which, as a result of the breakdown in production of the printing machine which occurs, are produced during the stoppage by accumulating rejects during the rethreading of a new printing material web into the machine and also during the removal of the previously printed and torn printing material web from the machine. Furthermore, a web break conceals the risk of the paper web winding up on printing-unit cylinders and, thus, the risk of massive damage to the printing units.

It is also disadvantageous that devices wherein the determination of the speed is performed with optical methods generally require very high purchasing costs and, in operation, are very sensitive to soiling and therefore require intensive maintenance. Devices wherein the measurement is performed with the aid of sound waves are additionally quite inaccurate and unreliable.

A further difficulty of the aforedescribed method results from the fact that, when optical methods are used, the measurement accuracy is not independent of the printed subject, because the reflectance level of the web varies as a function of the printed image.

SUMMARY OF THE INVENTION

It is therefore an object of the invention of the instant application to provide a method for detecting faults during the transport of a web, which overcomes the aforementioned disadvantages and which, in particular when web oscillations occur during which there is no risk of a web break, rules out the detection of a fault.

It is a further object of the invention to provide a device for detecting a fault during the transport of a web which overcomes the aforementioned disadvantages of the prior art and which, in particular, detects as a fault only those changes in the movement of the web which conceal the risk of a web break.

With the foregoing and other objects in view, there is provided, in accordance with one aspect of the invention, a method for detecting faults during transport of a web, wherein web speed is determined by contact-free measurement, in accordance with the Doppler principle, which comprises the following method steps: by applying microwaves, determining a first local speed of the web at a first measurement position; by applying microwaves, determining at least a second local speed of the web at a second measurement position spaced apart from the first measurement position in a direction of web transport; determining an actual value from the first local speed and at least the second local speed; determining any deviation of the actual value from a predefined desired value; and comparing the deviation of the actual value from the predefined desired value with a predefined threshold.

In accordance with another mode, the method of the invention includes detecting a web break, as a fault, during the transport of a paper web in a web-fed rotary printing machine.

In accordance with a further mode, the method of the invention includes determining the first local speed of the web and at least the second local speed of the web virtually simultaneously.

In accordance with an added mode, the method of the invention includes generating a control signal if the deviation of the actual value from the predefined desired value is greater than the predefined threshold.

In accordance with an additional mode, the method of the invention includes applying a computer program for calculating at least one of the actual value and the deviation of the actual value from the predefined desired value, in order to evaluate the local speeds of the web.

In accordance with yet another mode, the method of the invention includes varying at least one of the predefined desired value and the predefined threshold as a function of operating parameters of the printing machine.

In accordance with yet a further mode, the method of the invention includes transporting the web in a web-fed printing machine, and calculating the predefined desired value as a theoretical web speed based upon the mechanical speed of at least one subassembly in the printing machine.

In accordance with yet an added mode, the method of the invention includes at least one of triggering a machine stoppage and actuating at least one web-catching device in response to the control signal.

In accordance with another aspect of the invention, there is provided a device for detecting a fault during the transport of a web in a web-fed rotary printing machine, comprising a detector assembly for determining contact-free the speed of the web, in accordance with the Doppler principle, and for feeding information regarding the web speed to an evaluation unit disposed downline from the detector assembly in the transport direction of the web, the detector assembly including a first microwave detector located at a first measurement position, for determining a first local speed of the web and for feeding the determined information to the evaluation unit, at least a second microwave detector located at a second measurement position spaced apart from the first measurement position in the web transport direction, for determining a second local speed of the web and for feeding the determined information to the evaluation unit, the evaluation unit being capable of applying the determined information regarding the first and at least the second local speeds for determining an actual value, for determining a deviation of the actual value from a predefined desired value, and for comparing the deviation of the actual value from the predefined desired value with a predefined threshold.

In accordance with a further feature of the invention, at least one of the microwave detectors has a microwave antenna serving as a transmitter and a receiver.

In accordance with an added feature of the invention, at least one of the microwave detectors has a first microwave antenna and a second microwave antenna, the first microwave antenna serving as a transmitter, and the second microwave antenna serving as a receiver.

In accordance with an additional feature of the invention, the first microwave antenna is disposed in a first angular position relative to the web, and the second microwave antenna is disposed in a second angular position relative to the web, the second angular position differing from the first angular position.

In accordance with yet another feature of the invention, the detecting device includes, disposed on at least one subassembly of the printing machine, a detector for determining the mechanical speed of the respective subassembly, the detector serving to feed information regarding the mechanical speed of the subassembly to the evaluation unit.

In accordance with a concomitant aspect of the invention, there is provided a web-fed rotary printing machine, comprising a device for detecting a fault during the transport of a web in the printing machine, the detecting device including a detector assembly for determining contact-freely the speed of the web, in accordance with the Doppler principle, and for feeding information regarding the web speed to an evaluation unit disposed downline from the detector assembly in the transport direction of the web, the detector assembly including a first microwave detector located at a first measurement position, for determining a first local speed of the web and for feeding the determined information regarding the first local speed to the evaluation unit, at least a second microwave detector located at a second measurement position spaced apart from the first measurement position in the web transport direction, for determining a second local speed of the web and for feeding the determined information regarding the second local speed to the evaluation unit, the evaluation unit being capable of applying the determined information regarding the first and at least the second local speeds for determining an actual value, for determining a deviation of the actual value from a predefined desired value, and for comparing the deviation of the actual value from the predefined desired value with a predefined threshold.

It is a further object of the present invention to provide a device for detecting a fault during the transport of a web which overcomes the aforementioned disadvantages of the prior art and which, in particular, detects as a fault only those changes in the movement of the web which conceal the risk of a web break.

Thus, the method according to the invention for detecting faults during the transport of a web, in particular for detecting a web break during the transport of a paper web in a web-fed rotary printing machine, is distinguished by the fact that a first local speed of the web is determined at a first measurement position by using microwaves, and at least a second local speed of the web is determined at a second measurement position, spaced apart from the first measurement position in the web transport direction, by using microwaves, an actual value is determined from the first local speed and at least the second local speed, the deviation of the actual value from a predefined desired value is determined, and the deviation of the actual value from the predefined desired value is compared with a predefined threshold.

It is an advantage of the method of the invention and of the detecting device of the invention that, by their use, a fault can be detected reliably, quickly and cost-effectively and, to the greatest possible extent, without maintenance.

The aforedescribed method according to the invention advantageously permits the detection of faults during the transport of the web, changes in the speed of the web which are not based on a web break and which, for example, occur during longitudinal oscillations of the web, not being detected as a fault. To this end, the speed of the web is determined locally not just at one measurement position but, according to the invention, at least at two measurement positions, and the at least two measured local speeds of the web are then evaluated. As compared with a measurement using optical methods, the method of the invention has the advantage that the susceptibility to soiling is minimized as a result of the use of microwaves, and the intensity of the reflected signal is not influenced or is influenced only very slightly by the printed image passing by. As compared with the use of sound waves, the result when microwaves are used according to the invention is, additionally, the advantage that, because of the smaller wavelength, considerably finer and more precise tuning is achieved and, accordingly, inaccuracies and uncertainties in the individual measurements are not increased in an unrestricted manner.

The method according to the invention additionally provides the advantage that the determination of the local speeds of the web by using microwave radiation, as compared with the previously mentioned methods, is considerably more cost-effective with, at the same time, a higher reliability.

In addition, as a result of the insensitivity to soiling, the use of microwaves for implementing the method is to the greatest extent free of maintenance.

The at least two measurement positions can advantageously be arranged to follow one another in the web transport direction. It is possible, for example, for measurement positions to be provided between the individual successive printing units. Further measurement positions can be provided upline of the first printing unit, upline and/or downline of a dryer and also upline and/or downline of a cooling roller group. Furthermore, the measurement positions can be disposed upline from or in the folder, the last measurement position preferably being located upline of the first cross cutter. In this case, the relative arrangement of the respective measurement positions can advantageously be selected, as desired, so as to be perpendicular to the web transport direction if the intention is not to observe changes in the movement of the web transverse to the web transport direction.

According to a further mode of the method of the invention, the first and at least the second local speed of the web can be determined virtually or at least approximately simultaneously. As a result of the synchronous determination of the local web speeds, it is possible to avoid faulty detections of faults which, for example, are caused by a continuously increasing speed of the web during run-up of the printing machine.

In a further advantageous refinement of the method of the invention, a control signal can be generated if the deviation of the actual value from the predefined desired value is greater than the predefined threshold. Provision can further be made to trigger a machine stoppage as a function of this control signal, in order to prevent damage, in particular, to printing units of the printing machine. Provision can additionally be made to actuate at least one web-catching device, which seizes the free end of the paper web after a web break and removes the web from the printing units at high speed in order to prevent damage. In addition, when a fault is detected, an acoustic or optical signal can also be generated.

By predefining the desired value and the threshold, in the method of the invention, a controlling intervention by the pressman can advantageously be performed, for example, to match the desired value or the threshold to the respective printing material, the printing material properties, the moisture content of the printing material web, the type of print job, and so forth. A reduction in the threshold leads, for example, to a method in which faults during the transport of the web can be detected even in the case of small deviations, which is accordingly less fault tolerant. Such adaptations to the predefined values can, for example, be performed when changes occur in the modulus of elasticity of the paper web. For example, it is known that, as the diameter of the supply paper web reel decreases, the modulus of elasticity of the paper web decreases, as a result of which lower web stresses occur with the same web elongation. Furthermore, fluctuations in the paper thickness can also lead to changes in the modulus of elasticity.

The predefined desired value and/or the predefined threshold can also advantageously be varied as a function of operating parameters of the printing machine. For example, the predefined desired value and/or the predefined threshold can be varied as a function of the machine speed, which means that account can be taken of an increased level of interference which is associated with an increase in the speed.

In a further embodiment of the invention, in order to analyze the speed of the web, the actual value and/or the deviation of the actual value from the desired value can be determined by calculation, using a computer program, which means that the determinations can advantageously be changed and stored. In this case, the changes in the determinations can be input by the pressman and/or selected from stored predefinitions for, for example, different paper thicknesses, paper types, atmospheric humidity values, temperature values and quantities of ink and dampening solution, or they can be performed automatically. Provision can also be made for providing various algorithms for determining the values and for employing them under given operating conditions, for which the respective algorithm has been developed.

When the method is implemented by using a computer program, it is further advantageously possible to incorporate the aforementioned relationships between the predefined desired value and/or the predefined threshold with the operating parameters of the printing machine in the calculation as well, preferably automatically.

Furthermore, there is the possibility that the method, in a further step, subsequently makes the determinations which are carried out by using a computer program, and/or the results thereof, are visible to the pressman via an optical display.

For example, provision can advantageously be made, by the use of a computer program, to vary the threshold automatically as a function of the machine speed or the web speed, for example, to reduce it as the speed increases, in order to reduce the tolerance when detecting a fault, for example, a web break, and in this way to ensure greater certainty.

Provision can further be made for the predefined desired value to be a theoretical web speed which is calculated based upon the mechanical speed of at least one subassembly in the printing machine. For example, by means of a rotary encoder which is arranged on the shaft of the paper reel or a shaft of a cylinder of a printing unit in the printing machine, the mechanical speed of the subassembly in the printing machine can be determined and used to calculate a theoretical web speed. The theoretical web speed can then be used as a desired value during the evaluation of the speed of the web, and consequently it becomes readily possible to detect an increased speed of the web after a web break.

According to a further embodiment of the, it may be advantageous to make a selection from the available measurement positions, automatically or by the pressman, i.e., only a subset of the available measurement positions for determining the local speeds is used. For example, it is advantageously possible not to take into account such measurement positions at which, under given operating conditions, no web break is to be expected, so that there is a simplification of the evaluation method, and the result is therefore rapid and reliable evaluation and therefore also monitoring of the web speed and of a possible web break.

The device according to the invention for detecting faults during the transport of a web, in particular for detecting a web break during the transport of a paper web in a web-fed rotary printing machine, is distinguished by a first microwave detector at a first measurement position, which determines a first local speed of the web and supplies information regarding this first determined speed value to an evaluation unit, and also a second microwave detector at a second measurement position spaced apart from the first measurement position in the web transport direction, which determines a second local speed of the web and feeds information regarding this second determined speed value to the evaluation unit, the evaluation unit using the first local speed value and at least the second local speed value to determine an actual value, to determine the deviation of the actual value from a predefined desired value, and to compare the deviation of the actual value from the predefined desired value with a predefined threshold.

In a further embodiment of the invention, provision is made for at least one of the microwave detectors to include a microwave antenna that is used as a transmitter and as a receiver, which achieves an additional saving in costs. The microwave antenna can advantageously be arranged at a shallow angle to the surface of the web, which achieves an enhancement of the Doppler effect. Furthermore, the microwave antenna can advantageously be arranged at an angle of about 45 degrees to the surface of the web, because, in the case of an excessively flat arrangement of the antenna, radiation through the web can lead to reflections at moving parts of the printing unit, in particular, rotating parts, and therefore can lead to erroneous received signal evaluations.

However, according to a further preferred embodiment of the invention, it can likewise be advantageous for at least one of the microwave detectors to include a first microwave antenna and a second microwave antenna, the first microwave antenna being used as a transmitter and the second microwave antenna being used as a receiver. Thereby, the transmitter and the receiver can be arranged in different angular positions in relation to the web, and therefore reflections of the transmitted microwaves at moving parts of the printing units, in particular, rotating parts, can be blanked out, and only the reflections on the moving web can be used for further evaluation.

It is moreover possible for the microwave antenna to be constructed as a horn or planar antenna, it being possible for the planar antenna also to be constructed in the form of an array antenna.

In addition, provision can be made for the microwave detector to include, additionally, a digital signal processor, which generates a signal proportional to the web speed from the received frequency spectrum and forwards this signal to the evaluation unit disposed downline.

A further advantageous embodiment of the device according to the invention includes a detector which is arranged on at least one of the subassemblies in the printing machine, and determines the mechanical speed of the subassembly and feeds it to the evaluation unit, in order to be incorporated as the reference speed in the evaluation. The detector can be arranged, for example, on the shaft of the supply paper web reel or on a printing unit cylinder and determine the speed thereof.

Other features which are considered as characteristic for the invention are set forth in the appended claims.

Although the invention is illustrated and described herein as embodied in a method and device for detecting faults during transport of a web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
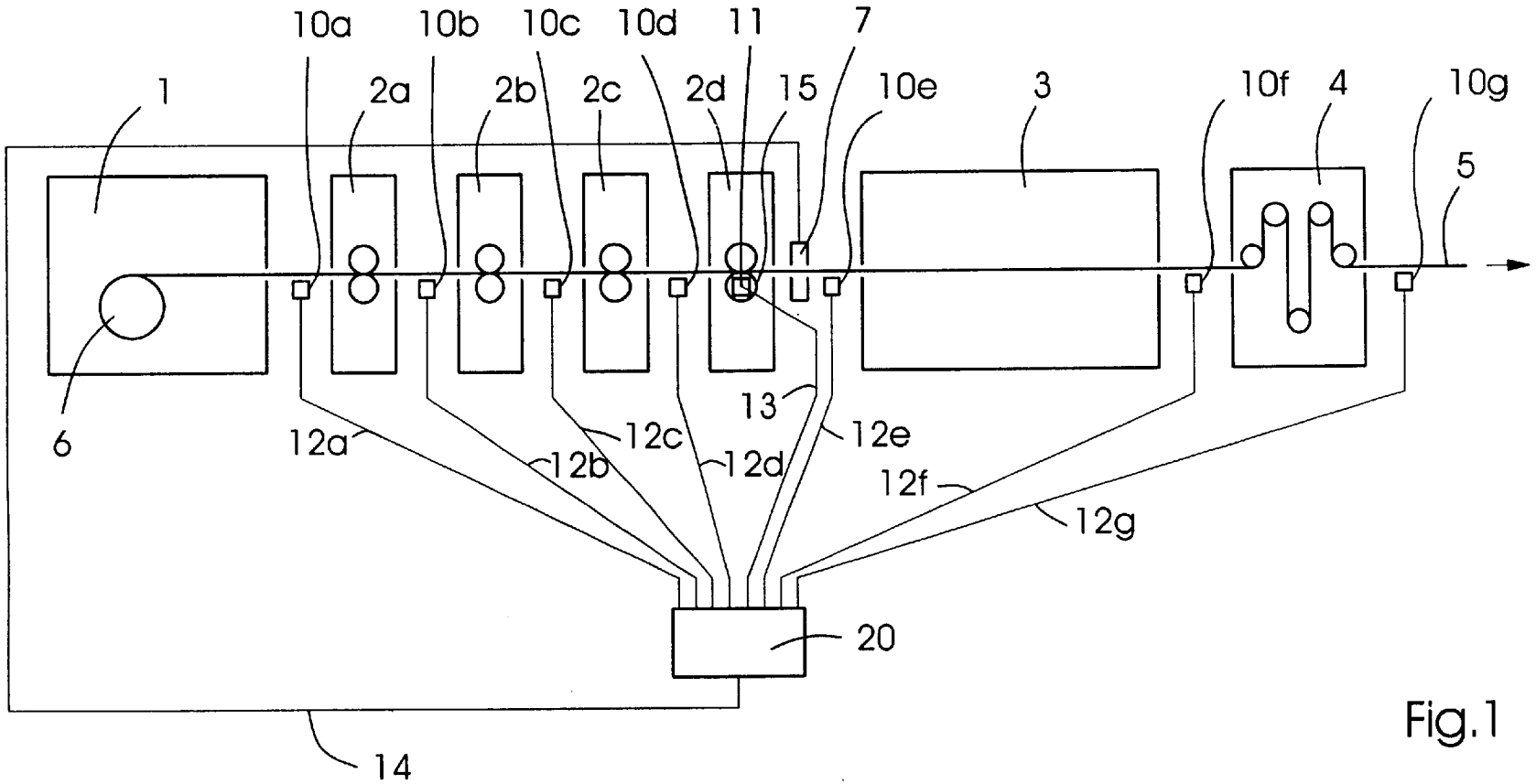
FIG. 1 is a diagrammatic and schematic side elevational view of a web-fed rotary printing machine with several measurement positions.

Referring now to the drawings and, first, particularly to FIG. 1 thereof, there is shown therein a diagrammatic and schematic side elevational view of a web-fed rotary printing machine of in-line construction, having a reel changer 1, four printing units 2*a* to 2*d*, a hot-air dryer 3 and a cooling roller unit 4. A paper web 5 is unwound from a paper reel 6 in the reel changer 1 and passes successively through the printing units 2*a* to 2*d*, the hot-air dryer 3, and the cooling roller unit 4 and is then supplied to a further processing unit, for example, a folder. The local speed of the web 5 is determined at a number of measurement positions by contact-free measurement using microwave detectors 10*a* to 10*g*, and the results of these measurements are fed to an evaluation unit 20 via signal lines 12*a* to 12*g* as signals proportional to the speed of the web. In order to determine the local speeds of the web 5 at the various measurement positions, each microwave detector has a microwave transmitter and receiver, it being possible for the transmitter and receiver to be two separate microwave antennas or the same microwave antenna.

The measurement of the speed of the web 5 is based in this case on the Doppler principle, which describes the physical phenomenon that transmitters and receivers, which are moved relative to one another, do not assign the same wavelength and frequency, respectively, to a wave. In this case, one also speaks of a frequency shift. When transmitted and reflected waves are received, the frequency shift effect is multiplied. Furthermore, the Doppler effect is angle-dependent, i.e., depends upon the angle between the propagation direction of the wave and the relative direction of movement of transmitter and receiver, no Doppler effect occurring in the case of mutually perpendicular directions. For the frequency shift resulting from the Doppler effect for the case wherein a stationary transmitter transmits waves which are reflected by a moving object and are received by a likewise stationary receiver, the following relationship applies:

$$\Delta f = f\left(\frac{1}{1+\frac{v}{c}(\pm\cos\alpha \mp \cos\beta)} - 1\right)$$

wherein Δf is the frequency shift f is the transmitted frequency (e.g. 24 GHz microwaves)

v is the speed of the moving object (e.g. the paper web)

c is the propagation speed of the wave (e.g. speed of light)

α is the angle between propagation direction of the transmitted wave and the direction of movement of the object, and β is the angle between propagation direction of the reflected wave and the direction of movement of the object, and wherein the signs of the cosine terms have to be matched with the choice of signs of the two angles so that, for the case α=β, the value of the frequency shift Af becomes equal to zero.

The frequency shifts which occur when microwaves are used ($c \approx 3 \cdot 10^8$ m/s) for determining the speed of a paper web ($v \approx 15$ m/s) are of the order of magnitude of $10^{-8}$.

FIG. 1 additionally shows a rotary encoder 11, which is arranged on the driven shaft of a cylinder 15 of the printing unit 2*d*, the encoder 11 generating a signal proportional to the mechanical speed of the cylinder 15 and feeding the signal to the evaluation unit 20 via a signal line 13. The signals fed to the evaluation unit 20 by the microwave detectors 10*a* to 10*g* and by the rotary encoder 11 are evaluated in the evaluation unit 20 in accordance with the flowchart shown in FIG. 4. If a web break is detected, a web-catching device 7 is triggered by a triggering signal fed to the web-catching device 7 via a signal line 14. The web-catching device 7 seizes the free end of the torn paper web 5 and pulls the latter away from the cylinders of the printing unit 2*d*. Moreover, when a web break is detected, a machine stoppage is triggered via further signal lines not shown in FIG. 1 upon the occurrence of the machine stoppage, all of the subassemblies of the printing machine are stopped as quickly as possible in order to avoid damage.

Figure 2:
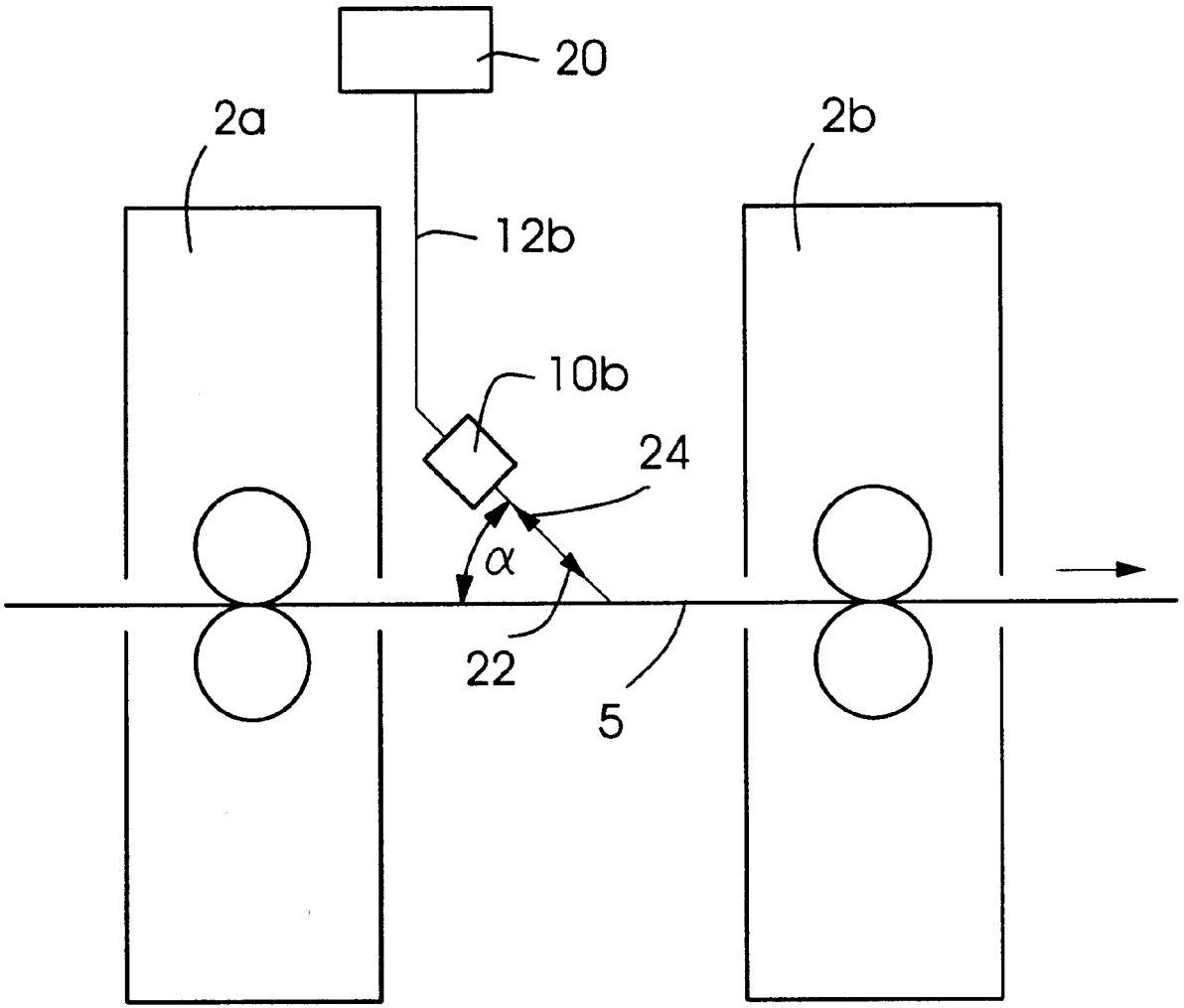
FIG. 2 is an enlarged fragmentary view of FIG. 1 showing a different embodiment of the invention wherein a microwave detector having one microwave antenna is located at least at one of the measurement positions.

FIG. 2 shows a microwave detector 10*b* which is disposed between two printing units 2*a* and 2*b* and which has one microwave antenna serving simultaneously as transmitter and as receiver. The moving paper web 5 is irradiated with microwaves 22 by the detector 10*b* and, as a result of the movement of the web 5, a frequency shift occurs in the reflected microwaves 24 which are received by the detector 10*b*. The detector 10*b* also has a digital signal processor which extracts the shifted frequency belonging to the moving web 5 from the received frequency spectrum and generates a signal proportional to the extracted frequency and, therefore, to the speed of the web 5, this signal being fed to the evaluation unit 20 via a signal line 12*b*. The microwave detector is preferably arranged in a manner relative to the paper web 5 that the transmitted microwaves 22 encounter the paper web 5 at an angle a of about 45 degrees. Because the detector 10*b* serves both as a transmitter as well as a receiver, the received microwaves 24 are also reflected from the paper web 5 at an angle a of about 45 degrees.

Figure 3:
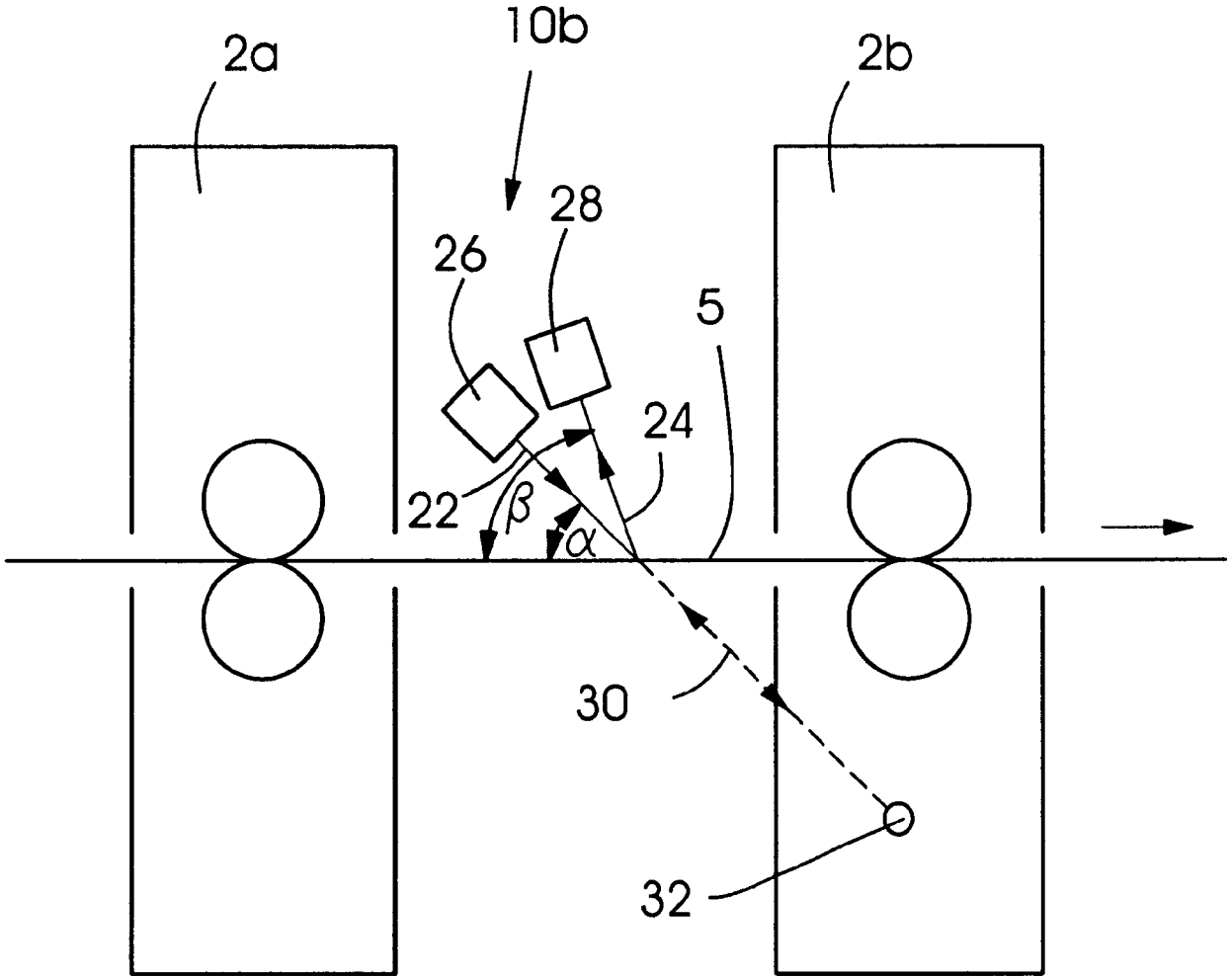
FIG. 3 is a view like that of FIG. 2 wherein a microwave detector having two microwave antennas is shown in another embodiment.

The arrangement of a microwave detector 10*b* shown in FIG. 3 shows an embodiment wherein the detector has two separate microwave antennas, one antenna being used as microwave transmitter 26 and the other antenna being used as microwave receiver 28. In this regard, the transmitter 26 is arranged relative to the paper web 5 so that the transmitted microwaves 22 encounter the paper web 5 at an angle $\alpha$ of about 45 degrees, while the receiver is arranged so that the received microwaves 24 are reflected from the paper web 5 at an angle $\beta$ of more than 45 degrees. This arrangement makes it possible to prevent signals 30 from moving parts of the printing unit, for example a rotating roller 32, from being superimposed on the signal from the moving web 5 so that separation of the two signals is impossible or possible only with great inaccuracy.

Figure 4:
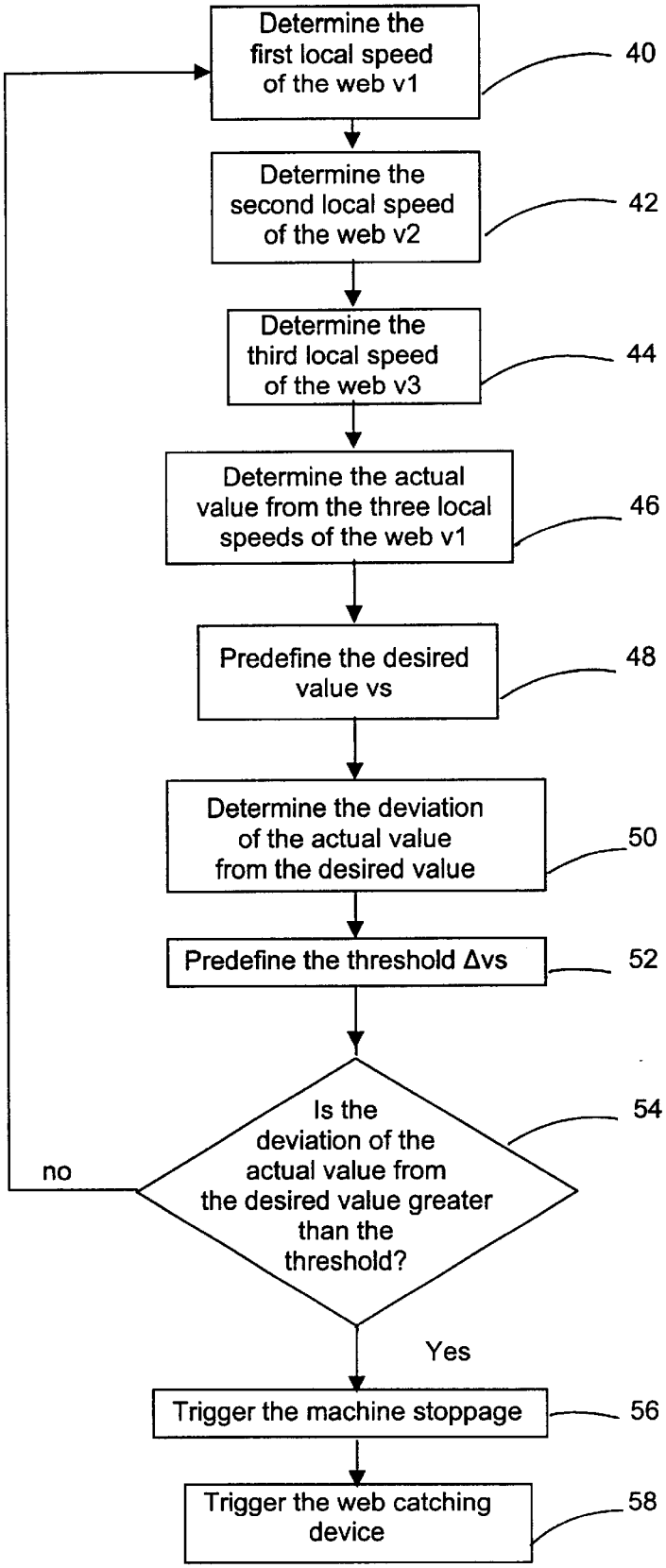
FIG. 4 is a flowchart outlining the method steps of the method according to the invention.

FIG. 4 is a flowchart of the method steps of the method according to the invention for detecting faults during the transport of a paper web in a web-fed rotary printing machine. In the method steps at 40, 42 and 44, local speeds $v_1$, $v_2$ and $v_3$ are determined, which, according to the invention, is effected by microwave detectors. The local speeds of the web can advantageously be determined virtually simultaneously. In a method step 46, the measured speeds $v_1$, $v_2$ and $v_3$ of the web serve for determining an actual value $v_i$. The actual value $v_i$ can be determined, for example, by averaging, forming a minimum or forming a maximum of the measured local speeds of the web $v_1$, $v_2$ and $v_3$. However, provision can also be made for the actual value $v_i$ to be determined not from all of the measured local speeds of the web but only from a subset of at least two of the measured local speeds, for example, the two measured local speeds of the web from two adjacent measurement positions. Furthermore, it is advantageously possible, when determining the actual value $v_i$, to introduce the measured local speeds of the web $v_1$, $v_2$ and v3 into the determination with different weights, $v_1$, $v_2$ and $v_3$, each of which having a weighting factor assigned thereto corresponding to the respective measurement position, the factor being proportional, for example, to the probability of a web break taking place in the vicinity of the measurement position. In addition, it may be possible to accept any one of the measured local speed values $v_1$, $v_2$ and $v_3$ individually as the actual value, so that the following method steps are not provided with a single actual value but a number of actual values for subsequent analysis. The number of actual values can in this case be equal to the number of measured local speeds or else less than that number, if a subset of the measurement positions has been selected for detecting faults. For each individual actual value, the following analysis can thereafter be carried out separately, it being possible for the respective analyses to be performed simultaneously or sequentially.

In a method step 48, a desired or nominal value $v_s$ is predefined, and may be a theoretical web speed calculated from the mechanical speed of at least one subassembly in the printing machine. The predefined desired value $v_s$ is compared with the actual value $v_1$ in a following method step 50. In this case, for example, the actual value $v_i$ determined as the average can be compared with the desired value $v_s$ by forming the difference. Furthermore, it is also possible to compare a number of actual values which, as mentioned above, can correspond to the individual measured local speeds $v_1$, $v_2$ and $v_3$, with the desired value $v_s$ by forming the difference in each case. In addition, provision can be made to use the measured speeds from adjacent measurement positions, as mentioned hereinabove, to determine an actual value $v_i$ in each case and to compare this actual value $v_i$ in each case with the desired value $v_s$, for example, by forming the difference. In method step 52, a threshold $\Delta v_s$ is predefined, and can be adapted, for example, to operating conditions such as web speed or web tension. Then, in the method step 54, the determined deviation between the actual value $v_i$ and the desired value $v_5$ is compared with the predefined threshold $\Delta v_s$, for example, by forming the difference. If, in this case, the deviation is greater than the predefined threshold $\Delta v_s$, in this case, in a method step 56, a control signal is generated, which triggers a machine stoppage and, in a further method step 58, triggers a web-catching device. If the deviation is not greater than the predefined threshold, the method will be re-executed beginning once again with the method step 40.

I claim:

1. A method for detecting faults during transport of a web, wherein web speed is determined by contact-free measurement, in accordance with the Doppler principle, which comprises the following method steps of: by applying microwaves, determining a first local speed of the web at a first measurement position; by applying microwaves, determining at least a second local speed of the web at a second measurement position spaced apart from the first measurement position in a direction of web transport; determining an actual value from the first local speed and at least the second local speed; determining any deviation of the actual value from a predefined desired value; and comparing the deviation of the actual value from the predefined desired value with a predefined threshold.

2. The method according to claim 1, which includes detecting a web break, as a fault, during the transport of a paper web in a web-fed rotary printing machine.

3. The method according to claim 1, which includes determining the first local speed of the web and at least the second local speed of the web virtually simultaneously.

4. The method according to claim 1, which includes generating a control signal if the deviation of the actual value from the predefined desired value is greater than the predefined threshold.

5. The method according to claim 1, which includes applying a computer program for calculating at least one of the actual value and the deviation of the actual value from the predefined desired value, in order to evaluate the local speeds of the web.

6. The method according to claim 1, which includes varying at least one of the predefined desired value and the predefined threshold as a function of operating parameters of the printing machine.

7. The method according to claim 1, which includes transporting the web in a web-fed printing machine, and calculating the predefined desired value as a theoretical web speed based upon the mechanical speed of at least one subassembly in the printing machine.

8. The method according to claim 4, which includes at least one of triggering a machine stoppage and actuating at least one web-catching device in response to the control signal.

9. A device for detecting a fault during the transport of a web in a web-fed rotary printing machine, comprising a detector assembly for determining without contact the speed of the web, in accordance with the Doppler principle, and for feeding information regarding the web speed to an evaluation unit disposed downline from said detector assembly in the transport direction of the web, said detector assembly including a first microwave detector located at a first measurement position, for determining a first local speed of the web and for feeding the determined information to said evaluation unit, at least a second microwave detector located at a second measurement position spaced apart from said first measurement position in the web transport direction, for determining a second local speed of the web and feeding the determined information to said evaluation unit, said evaluation unit being capable of applying said determined information regarding the first and at least the second local speeds for determining an actual value, for determining a deviation of said actual value from a predefined desired value, and for comparing the deviation of said actual value from said predefined desired value with a predefined threshold.

10. The detecting device according to claim 9, wherein at least one of said microwave detectors has a microwave antenna serving as a transmitter and a receiver.

11. The detecting device according to claim 9, wherein at least one of said microwave detectors has a first microwave antenna and a second microwave antenna, said first microwave antenna serving as a transmitter, and said second microwave antenna serving as a receiver.

12. The detecting device according to claim 11, wherein said first microwave antenna is disposed in a first angular position relative to the web, and said second microwave antenna is disposed in a second angular position relative to the web, said second angular position differing from said first angular position.

13. The detecting device according to claim 9, including, disposed on at least one subassembly of the printing machine, a detector for determining the mechanical speed of the respective subassembly, said detector serving to feed information regarding the mechanical speed of the subassembly to said evaluation unit.

14. A web-fed rotary printing machine, comprising a device for detecting a fault during the transport of a web in the printing machine, the detecting device including a detector assembly for determining without contact the speed of the web, in accordance with the Doppler principle, and for feeding information regarding the web speed to an evaluation unit disposed downline from said detector assembly in the transport direction of the web, said detector assembly including a first microwave detector located at a first measurement position, for determining a first local speed of the web and for feeding the determined information regarding the first local speed to said evaluation unit, at least a second microwave detector located at a second measurement position spaced apart from said first measurement position in the web transport direction, for determining a second local speed of the web and for feeding the determined information regarding the second local speed to said evaluation unit, said evaluation unit being capable of applying said determined information regarding the first and at least the second local speeds for determining an actual value, for determining a deviation of said actual value from a predefined desired value, and for comparing the deviation of said actual value from said predefined desired value with a predefined threshold.

* * * * *